United States Patent [19]

Livingstone

[11] Patent Number: 4,498,200

[45] Date of Patent: Feb. 12, 1985

[54] GARMENT HAVING CONCEALED POUCH

[76] Inventor: Jeanne Livingstone, 1025 Stuart St., Helena, Mont. 59601

[21] Appl. No.: 403,541

[22] Filed: Jul. 30, 1982

[51] Int. Cl.[3] ..... A41D 27/20; A41D 1/14

[52] U.S. Cl. ..... 2/247; 2/211

[58] Field of Search ..... 128/513; 2/94, 105, 2/211, 247–251, 48, 252–254

[56] References Cited

U.S. PATENT DOCUMENTS

| | | | |
|---|---|---|---|
| 926,402 | 6/1909 | Geissler | 2/247 |
| 1,196,324 | 8/1916 | Atkins | 2/211 |
| 1,936,045 | 11/1933 | Bachrack | 2/247 |
| 2,624,881 | 1/1953 | Lee | 128/513 |

FOREIGN PATENT DOCUMENTS

| | | | |
|---|---|---|---|
| 1373791 | 10/1964 | France | 2/94 |

*Primary Examiner*—Doris L. Troutman
*Attorney, Agent, or Firm*—John Gibson Semmes

[57] ABSTRACT

A garment pouch for retaining and concealing small personal valuables. One or more concealed hemline pockets are provided in an undergarment shirt or blouse, the upper edges of which preferably lie adjacent the hemline. The closure for the pocket, which is co-extensive with stitching above the selvage and the lower edge of the pocket, comprises the selvage itself. The closure or closures for the pockets are in-line with the hem stitching line, defining a continuity thereof. If one closure is provided, it may function to close two or more adjacent pockets or pouches in the hem, the pockets being devisable from each other by vertical stitching from hemline to selvage. The pockets may be made easily accessible from either the exterior or interior of the garment and may also be adapted to sportswear having the undergarment as an integral part of the whole, for example, as in golf skirts, tennis and swimwear having outerskirt and inner pants. The wearer of the garment pouch need not undress to retrieve the valuables quickly and easily from any of the garment pocket locations.

2 Claims, 5 Drawing Figures

GARMENT HAVING CONCEALED POUCH

BACKGROUND OF THE INVENTION

The Prior Art

The prior art is best represented by the patents to M. Sophier, U.S. Pat. No. 2,359,012; A. E. Weatherly, U.S. Pat. No. 2,593,711; A. E. Harvey, U.S. Pat. No. 2,492,862 and finally M. Wallach, U.S. Pat. No. 4,145,762. Whereas the aforesaid art is directed to the formation of various pocket-equipped garments and in some instances concealed pockets, no effort has been made to form the pouch of integral garment elements, notably found in or around the locus of the hemline, which is more especially represented by the hem stitching line and the selvage. This invention, as will be noted, is directed to the latter, in distinction over the former.

SUMMARY OF THE INVENTION

The invention, as will be more fully described hereinafter, is directed primarily to the formation of a concealed pocket or pouch, the principal elements of which are formed from normal components of the garment itself, most notably, as in female clothing the hem, the hem stitching line and/or the selvage. For example, the invention would be particularly adapted to the formation of a concealed pocket in a half-slip or full slip wherein the closure of the invention is defined in continuity with the hem stitching line and wherein the bottom portion of the same comprises the selvage of the hem of such a garment. The exact location of the hem stitching line directly influences the actual size of the pocket. Since the pockets are located at the hemline, the valuables do not add girth to the hips or waist and are easily retrieved without undressing. These and other objectives of invention will become more apparent from reference of the following drawings in which:

DESCRIPTION OF THE PREFERRED EMBODIMENTS

Figure 1:
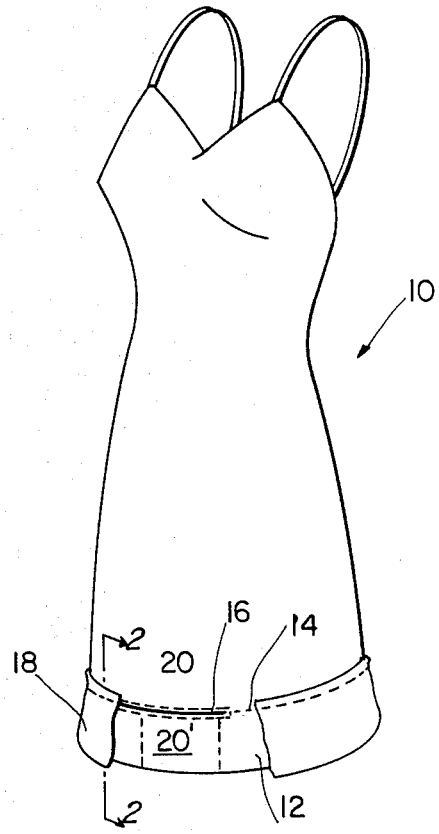
FIG. 1 is a vertical front elevational view of a skirt or slip, a portion thereof being broken away to reveal the details of the invention.
Figure 4:
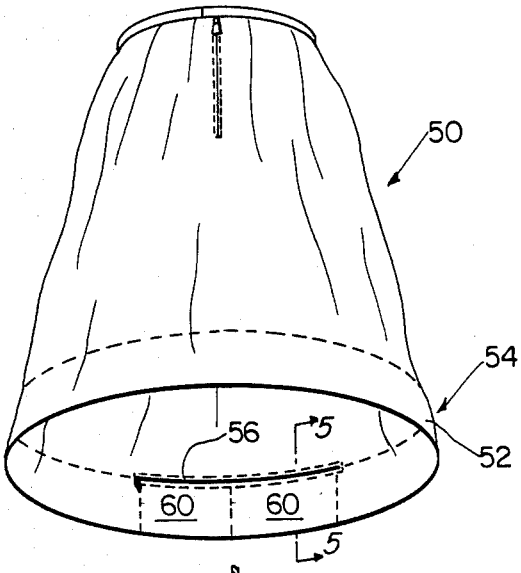
FIG. 4 is a vertical view as applied to a half-slip wherein the pockets have closure on the inside.
Figure 2:
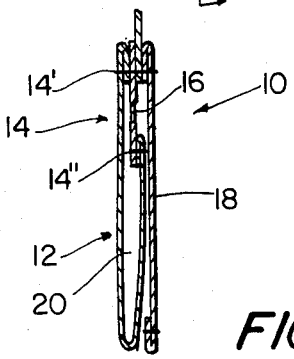
FIG. 2 is a vertical sectional view of the invention of FIG. 1 taken along the lines 2—2 thereof.

With reference to the drawings, FIG. 1 illustrates a preferred embodiment of the invention as applied to a halfslip, or full slip, wherein the concealed pockets are opened exteriorly, as opposed to the FIG. 4 configuration wherein the pockets may be opened interiorly. The halfslip or full slip 10 includes a hem 12 which is of conventional design. The hem 12 is secured to the slip by the seam, the hem being folded upon itself and stitched at the hemstitching line 14, extending the full circumference of the skirt just above the hem. A sufficient distance above the selvage of the hem to accommodate pockets which are formed by the hem itself. An appropriate closure 16 is secured so that its closure element, in this case a zipper, (but said closure could be of VELCRO, snaps or buttons) is on precisely the same in-line position of the skirt as is the hemstitching line 14. To effect, the desired concealed pocket result, it will be noted that the hem having once been folded upon itself at the bottom, is twice folded upon itself and stitched the skirt as at 14', the stitching passing through the upper element of the closure 16 and also the upper portion of the concealing flap 18. Again, the hemstitching line having been broken to accommodate the closure 16 is, at its lower most portion, secured to the lower most portion of the closure 16 as at 14''. Thus, the pocket 20 is formed, reference the vertical section of the FIG. 1 configuration as at FIG. 2, the same comprising an enlarged view of a portion of the combination.

Figure 3:
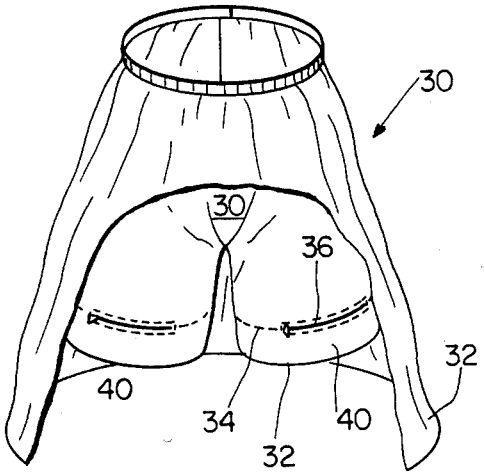
FIG. 3 is a front elevational view of the invention as applied to a golf skirt, portions thereof having been broken away to show the adaptation of the invention to integral underpants made a part of the skirt.

A variation of the invention is illustrated in FIG. 3 wherein the golf skirt or other related athletic skirt 30 has integrally formed therein underpants 30, the same having hems at the bottom of each of the legs forming the pants, the hems 32, together with hemstitching line 34 and closure 36, creating the concealed pockets 40.

Figure 5:
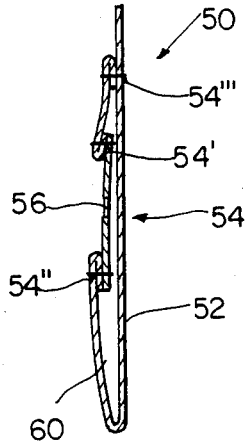
FIG. 5 is a vertical sectional view of the invention taken along the lines 5—5 of FIG. 4.

Reference FIGS. 4 and 5 a further modification of the invention is shown, wherein the skirt 50 having hem 52 and hemstitching line 54 is adapted, together with the closure 56 to form the pockets 60, the same being accessible from the interior of the skirt 50. By reference to FIG. 5 it will be noted that the skirt 50 is folded upon itself from outside to inside, the interrupted end of the hem 52 being stitched as 54', 54'', 54'''.

Whereas the invention has, for purposes of illustration been depicted in the drawings and specification as adapted to women's clothing, it is equally adapted to such men's clothing as defines a hem at any portion of an open end as in pants cuffs, sleeve cuffs, athletic pants and shorts, having built-in athletic supporters and the like.

The scope of the invention is defined by the appended claims wherein:

I claim:

1. In combination with a garment having a hem at an open end thereof, at least one pocket defined by the hem adjacent the open end, said hem being folded on itself and stitched and held fast to the outer material of the garment by hemstitching, said hemstitching which is a sufficient distance above the selvage of the hem to accommodate said pocket, the pocket being sealable by a linear closure element that is integral with the inside hem material of the garment and being disposed at direct in-line continuation and interconnection of the hemstitching line, the hemstitching line being discontinued to accommodate the pocket, said linear closure element being secured by stitching directly to each end of the hemstitching line and thus to the outer material of the garment.

2. The garment according to claim 1 wherein plural pockets are formed in the seam by permanent vertical binding of selected portions of the seam to each other.

* * * * *